US005329848A

United States Patent [19]

Yasui et al.

[11] Patent Number: 5,329,848

[45] Date of Patent: Jul. 19, 1994

[54] STAMP DEVICE CAPABLE OF PERFORATING THERMAL STENCIL PAPER

[75] Inventors: Tsuneo Yasui; Takemi Yamamoto; Takashi Miki, all of Nagoya; Tetsuji Fuwa, Hashima, all of Japan

[73] Assignee: Brother Kogyo Kabushiki Kaisha, Nagoya, Japan

[21] Appl. No.: 998,790

[22] Filed: Dec. 29, 1992

Related U.S. Application Data

[63] Continuation-in-part of Ser. No. 811,974, Dec. 23, 1991, Pat. No. 5,253,581.

[30] Foreign Application Priority Data

| | | | |
|---|---|---|---|
| Dec. 29, 1990 | [JP] | Japan | 2-417190 |
| May 9, 1991 | [JP] | Japan | 3-104225 |
| May 27, 1991 | [JP] | Japan | 3-121028 |
| Feb. 21, 1992 | [JP] | Japan | 034961 |

[51] Int. Cl.[5] ..... B41L 13/02

[52] U.S. Cl. ..... 101/121; 101/125; 101/127.1

[58] Field of Search ..... 101/125, 126, 127–129, 101/117, 118, 119, 120, 122, 121

[56] References Cited

U.S. PATENT DOCUMENTS

| | | | |
|---|---|---|---|
| 3,541,956 | 11/1970 | Falchero . | |
| 3,799,053 | 3/1974 | Rabelow . | |
| 4,497,848 | 2/1985 | Baran . | |
| 4,628,813 | 12/1986 | Hasegawa et al. . | |
| 4,718,340 | 1/1988 | Love, III . | |
| 4,957,378 | 9/1990 | Shima . | |
| 5,133,919 | 7/1992 | Hasegawa et al. | 101/114 |

FOREIGN PATENT DOCUMENTS

| | | |
|---|---|---|
| 0130612 | 3/1986 | European Pat. Off. . |
| 0493965A1 | 7/1992 | European Pat. Off. . |
| 3806356A1 | 6/1988 | Fed. Rep. of Germany . |
| 692160 | 10/1930 | France . |
| 63-39377 | 2/1963 | Japan . |
| 54-9523 | 4/1979 | Japan . |
| 61-28771 | 12/1986 | Japan . |
| 62-73988 | 4/1987 | Japan . |
| 62-264995 | 11/1987 | Japan . |
| 63-11855 | 1/1988 | Japan . |
| 63-224987 | 9/1988 | Japan . |
| 3-243387 | 10/1991 | Japan . |
| 498186 | 5/1976 | U.S.S.R. . |

*Primary Examiner*—David A. Wiecking
*Assistant Examiner*—John S. Hilten
*Attorney, Agent, or Firm*—Oliff & Berridge

[57] ABSTRACT

To eliminate wasteful use of thermal stencil paper and thereby provide an inexpensive stamp device, a single thermal head is employed for both the thermal recording on a reversible thermal recording sheet for confirmation of a stamp image and the thermal perforation through the thermal stencil paper for creation of a stamp original. The stamp image is first thermally recorded on the reversible thermal recording sheet; the stamp image thus recorded is then confirmed; and the thermal stencil paper is thermally perforated in accordance with the stamp image to create the stamp original. The stamp device of the present invention includes a thermal head 19, a thermal stencil paper 24 adapted to be thermally perforated by the thermal head 19 to form a dot image as a stamp image, a reversible thermal recording sheet 101 adapted to be heated by the thermal head 19 to thermally record an image corresponding to the stamp image, so as to confirm the stamp image, and a heating roller pair 90 for erasing the image thermally recorded on the reversible thermal recording sheet 101.

21 Claims, 14 Drawing Sheets

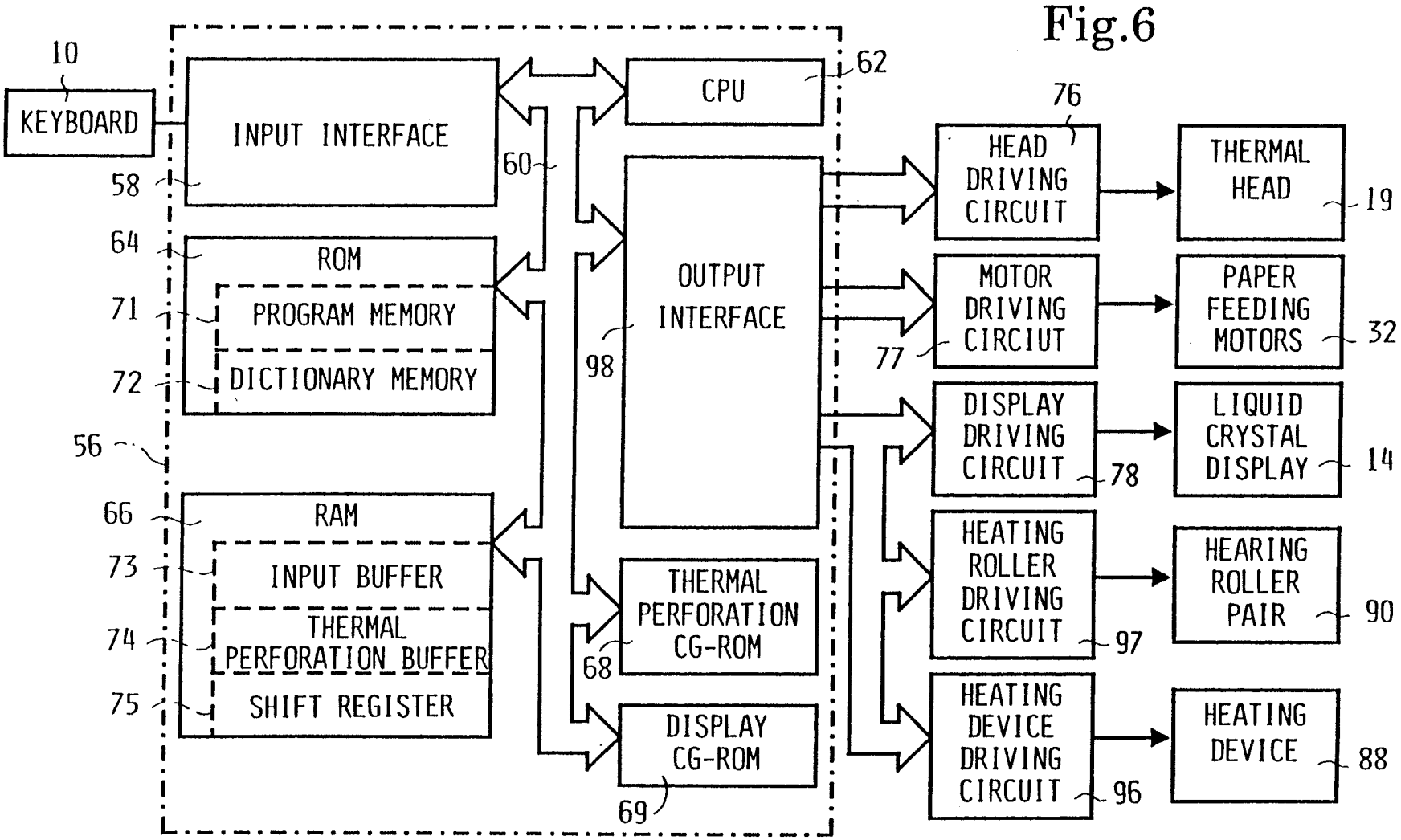
Fig.6
THERMAL HEAD
19
PAPER FEEDING MOTORS
32
LIQUID CRYSTAL DISPLAY
14
HEARING ROLLER PAIR
90
HEATING DEVICE
88
HEAD DRIVING CIRCUIT
76
MOTOR DRIVING CIRCIUT
77
DISPLAY DRIVING CIRCUIT
78
HEATING ROLLER DRIVING CIRCUIT
97
HEATING DEVICE DRIVING CIRCUIT
96
CPU
62
OUTPUT INTERFACE
98
THERMAL PERFORATION CG-ROM
68
DISPLAY CG-ROM
69
INPUT INTERFACE
60
ROM
PROGRAM MEMORY
DICTIONARY MEMORY
RAM
INPUT BUFFER
THERMAL PERFORATION BUFFER
SHIFT REGISTER
KEYBOARD
10
58
64
71
72
56
66
73
74
75

Fig.7B

| ITEM | INSTRUCTIONS |
|---|---|
| S1 | INITIALIZE |
| S2 | KEY SCAN |
| S3 | CHARACTER KEY ? |
| S4 | DATA INPUT PROCESSING |
| S5 | DISPLAY INPUT CHARACTERS ON DISPLAY |
| S6 | ORIGINAL CREATING KEY ? |
| S7 | DEVELOP INPUT DATA IN THERMAL PERFORATION BUFFER |
| S8 | TRANSFER DOT ROW TO SHIFT REGISTER AND PERFORM THERMAL PERFORATION |
| S9 | THERMAL PERFORATION COMPLETED ? |
| S12 | ERASING KEY ? |
| S13 | START ROTATION OF HEATING ROLLER PAIR |
| S14 | START HEATING OF HEATING DEVICE |
| S15 | ERASING COMPLETED ? |
| S16 | STOP HEATING OF HEATING DEVICE |
| S17 | STOP ROTATION OF HEATING ROLLER PAIR |
| S19 | OTHER KEYS ? |
| S20 | OTHER PROCESSING |
| S30 | CONFIRMING KEY ? |
| S31 | DEVELOP INPUT DATA IN THERMAL PERFORATION BUFFER |
| S32 | TRANSFER DOT ROW TO SHIFT REGISTER AND HEAT THERMAL HEAD |
| S33 | HEATING COMPLETED ? |
| S34 | DISCHARGE REVERSIBLE SHEET |

STAMP DEVICE CAPABLE OF PERFORATING THERMAL STENCIL PAPER

This is a continuation-in-part application of U.S. application Ser. No. 07/811,974, filed Dec. 23, 1991, now U.S. Pat. No. 5,252,581.

BACKGROUND OF THE INVENTION

1. Field of the Invention

The present invention relates to a stamp device for forming an image on a thermal stencil paper and transferring the image to a recording paper and, more particularly, to a stamp device enabling an operator to confirm the image to be formed on the thermal stencil paper.

2. Description of the Related Art

A rubber stamp is conventionally used to print various representations such as an address and name of a person or company. Such a rubber stamp is useful and convenient in the case of repeatedly printing the same characters. Another type of printing device is a depression type stamp device employing a thermal stencil paper as described in parent U.S. patent application Ser. No. 07/811,974. This device will now be described with reference to the drawings.

FIG. 9 is a perspective view of a stamp device 1 of the parent application. The stamp device 1 includes a keyboard 10, a body 11, a stamp 12, and a liquid crystal display (which will be hereinafter referred simply to as a "display") 14 having the predetermined number of display columns. The keyboard 10 includes a character key 42 for inputting characters such as Japanese "kana" character and alphabet, and also includes various function keys such as a stamp original creating key.

As shown in FIG. 8 which is a cross section taken along the line F—F in FIG. 9, the body 11 is constituted of a stencil paper holding section 15, an original creating section 16, a stamp holding section 17, and a control section 18. The stamp 12 is constituted of a grip 13, a stamp body 28, a spring 29, and an ink pad 30. The original creating section 16 includes a thermal head 19 as heating means. The thermal head 19 is pressed against a platen roller 20. A thermal stencil paper (which will be hereinafter referred simply to as a "stencil paper") 24 is drawn by a stencil paper drawing roller 21, and is fed by stencil paper feeding roller pairs 22 to between the thermal head 19 and the platen roller 20.

After the stencil paper 24 is thermally perforated by the thermal head 19, it is further fed by the stencil paper feeding roller pairs 22 and stencil paper feeding rollers 23 to under the stamp 12. The stamp body 28 of the stamp 12 is secured to a supporting member (not shown) with a gap 27 defined between the ink pad 30 and the stencil paper feeding rollers 23 in the stamp holding section 17. The thermally perforated stencil paper 24 is fed by the stencil paper feeding roller pairs 22 and the stencil paper feeding rollers 23 by a predetermined amount so as to come to just under the ink pad 30.

The stencil paper 24 is formed by bonding a thermoplastic film to a porous carrier. The stencil paper 24 is used under the condition where the thermoplastic film side is adapted to contact the thermal head 19. As shown in FIGS. 10 and 11, a frame 25 is bonded onto the stencil paper 24.

The thermal head 19 has a head body provided with a heat generating element array. The heat generating element array consists of a plurality of heat generating elements, e.g., 96 heat generating elements are arranged in line in the stamp device 1. These heat generating elements are arranged adjacent to each other in a direction perpendicular to a feeding direction of the stencil paper 24. The heat generating element array is driven at a predetermined timing in accordance with feed of the stencil paper 24 to thereby thermally perforate the stencil paper 24 according to data input from the keyboard 10.

A control system of the stamp device 1 will be described with reference to the block diagram shown in FIG. 12. The keyboard 10 is connected to an input interface 58 in a microcomputer 56. The input interface 58 is connected through a bus line 60 to a CPU 62, a ROM 64, a RAM 66, a character generator (CG-ROM) 68 for thermal perforation of the stencil paper 24, a character generator (CG-ROM) 69 for display, and an output interface 70.

The ROM 64 includes a program memory 71 previously storing a program for controlling the whole operation of the stamp device 1 and a dictionary memory 72 to be used for kana/kanji conversion where Japanese "kana" characters are converted into Chinese "kanji" characters or the like. The RAM 66 includes an input buffer 73 for storing data input from the keyboard 10, a thermal perforation buffer 74 and a shift register 75 for storing data for thermal perforation of the stencil paper 24, and other necessary counters and registers.

The CG-ROM 68 serves to generate dot patterns according to code data of characters input, and the CG-ROM 69 serves to generate dot patterns to be displayed on the display 14.

A head driving circuit 76, a motor driving circuit 77 and a display driving circuit 78 are connected to the output interface 70. The thermal head 19, paper feeding motors 32 and the display 14 are connected to the circuits 76, 77 and 78, respectively.

The operation of creating a stamp original by the stamp device 1 will now be described with reference to the flowchart shown in FIG. 13. When power is applied to the stamp device 1, the buffers, registers, etc. in the RAM 66 are initialized, and the others are also initialized in step S1 (which will be hereinafter referred simply to as "S1" and the other steps will also similarly referred). Then, a string of characters is input from the keyboard 10 with the characters displayed on the display 14. That is, data for thermal perforation is input from the character key 42, and it is stored into the input buffer 73 in S2, S3 and S4. At the same time, in S5, the characters corresponding to the thermal perforation data are displayed on the display 14 through the CG-ROM 69.

When the stamp original creating key is depressed, S7 is executed after S2 and S6, in which the dot patterns generated in the CG-ROM 68 according to the code data input are developed in the thermal perforation buffer 74. Then, the program proceeds to S8 in which the dot patterns developed in the thermal perforation buffer 74 are transferred by every row of dots to the shift register 75 to thermally perforate the stencil paper 24 in accordance with the row of dots. In S9, it is determined whether or not all the thermal perforation data have been output to the stencil paper 24, and the steps of S8 and S9 are repeated to finally obtain the result of thermal perforation constituted of 96 dots over the length of the heat generating element array. At this time, the thermally perforated stencil paper 24 is fed by the stencil paper feeding roller pairs 22 and the stencil paper feeding rollers 23 in a direction D shown in FIG. 8.

When the grip 13 of the stamp 12 is depressed toward the stencil paper 24 against the spring 29, the ink pad 30 comes into contact with the stencil paper 24. Owing to the viscosity of ink impregnated in the ink pad 30, the stencil paper 24 adheres to the ink pad 30. Then, the stamp 12 is pulled out of the stamp holding section 17 of the body 11 of the stamp device 1 by holding the grip 13. Thereafter, the grip 13 of the stamp 12 is depressed toward a recording paper 35 in a direction H shown in FIG. 14, and the ink impregnated in the ink pad 30 is supplied to the stencil paper 24. As a result, a part of the ink at a thermally perforated portion only of the stencil paper 24 is allowed to reach the recording paper 35, thus forming an image on the recording paper 35 as shown in FIG. 15.

However, resolution of the liquid crystal display is greatly lower than that of the thermal head. Accordingly, when an operator intends to confirm a stamp image formed after inputting data from the keyboard, the stamp image cannot be clearly confirmed on the liquid crystal display. So, the operator is obliged to actually print the input data as a sample or view the perforation image on the stencil paper attached to the stamp. If the stamp image is not satisfactory in the sample or as viewed in the perforation, the stencil paper is obliged to be wasted.

SUMMARY OF THE INVENTION

An object of the present invention is to provide a stamp device which enables the stamp image to be confirmed without wasting the stencil paper.

To achieve the above and other objects, a stamp device is provided including storing means for storing image data representing an image, first heating means for generating heat based on the image data stored by the storing means, stencil paper feeding means for feeding the first heating means with a thermal stencil paper which is thermally perforated by heat generated by the first heating means, and recording sheet feeding means for feeding the first heating means with a thermal recording sheet which is visibly recorded by heat generated by the first heating means, wherein the thermal recording sheet is used to confirm the image to be perforated on the thermal stencil paper before thermally perforating the thermal stencil paper.

In the stamp device according to the present invention, image data representing an image such as an arbitrary figure or string of characters are stored in the storing means. Then, the thermal recording sheet is fed to the first heating means by the recording sheet feeding means. A dot image corresponding to the stored image data is thermally formed on the thermal recording sheet by the first heating means. After confirming the image thus recorded on the thermal recording sheet, the thermal stencil paper is fed to the first heating means by the stencil paper feeding means. The thermal stencil paper is thermally perforated by the first heating means to form the dot image corresponding to the stored image data. Then, the thermal stencil paper thus perforated to have the image is attached to a stamp. Then, the stamp is depressed on a recording paper to transfer the image from the thermal stencil paper to the recording paper.

BRIEF DESCRIPTION OF THE DRAWINGS

A preferred embodiment of the present invention will now be described with reference to the figures wherein:

FIG. 6 is a block diagram illustrating the control system of the stamp device;

FIG. 7B is a table listing the steps of the flowchart of FIG. 7A;

DETAILED DESCRIPTION OF PREFERRED EMBODIMENTS

Figure 3:
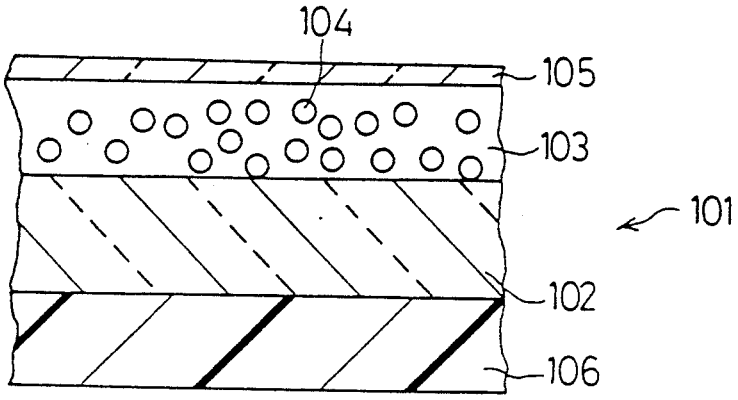
FIG. 3 is a schematic partial sectional view of the reversible thermal recording sheet.

First, there will be described a reversible thermal recording sheet (which will be hereinafter referred simply to as a "reversible sheet") 101 with reference to FIGS. 3, 4 and 5. Such a reversible sheet is known as a thermo-chromic in Japanese Patent Laid-open No. Sho 63-39377, for example. Referring to FIG. 3 which is a sectional view of the reversible sheet 101, a recording layer 103 is formed on a transparent polyester film 102, and an overcoat layer 105 is formed on the recording layer 103, so as to protect the same. The recording layer 103 is constituted of resin and organic low-molecular substance 104 dispersed in the resin.

Figure 4:
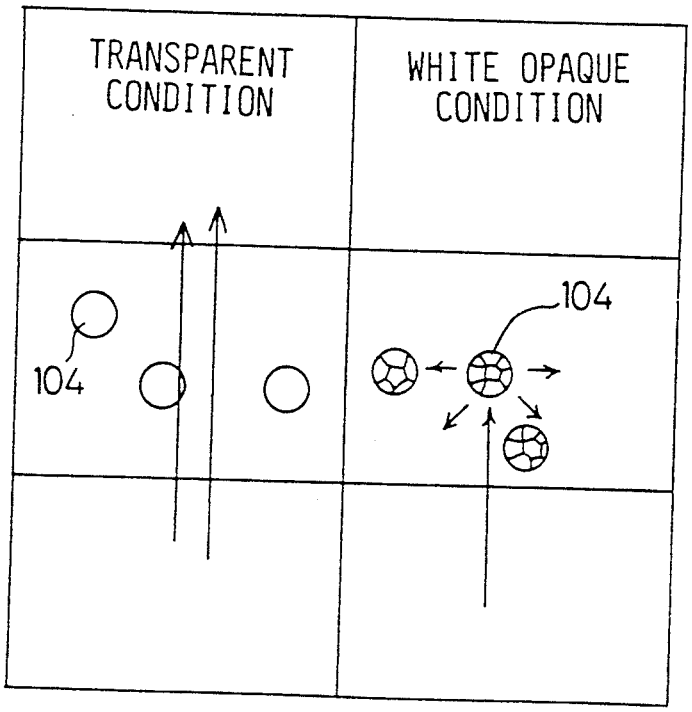
FIG. 4 is a schematic view illustrating a transparent condition and a white opaque condition of the reversible thermal recording sheet.

FIG. 4 shows a transparent condition and a white opaque condition of the reversible sheet 101. In the transparent condition shown on the left-hand side in FIG. 4, each particle of the organic low-molecular substance 104 in the reversible sheet 101 is formed as a relatively large monocrystal, so that light incident into the reversible sheet 101 passes an interface of the crystal few times and is transmitted through the reversible sheet 101 without scattering. Therefore, the reversible sheet 101 looks transparent as a whole. On the other hand, in the white opaque condition shown on the right-hand side in FIG. 4, each particle of the organic low-molecular substance 104 in the reversible sheet 101 is formed as a polycrystal, so that light incident into the reversible sheet 101 is refracted at the interface of the crystal many times and is scattered. Therefore, the reversible sheet 101 looks white opaque as a whole.

Figure 5:
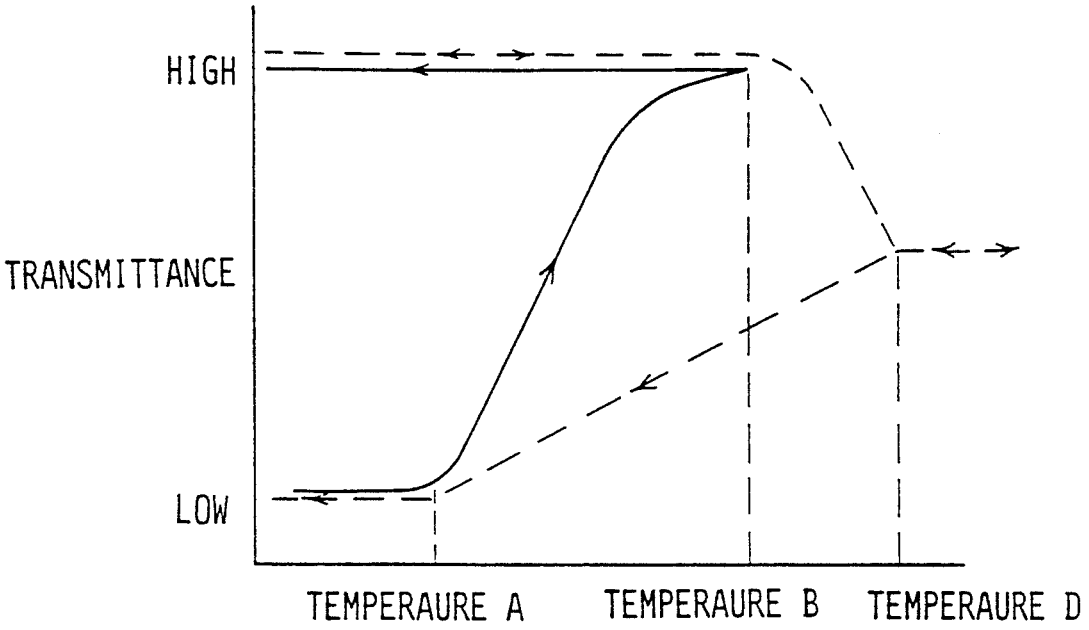
FIG. 5 is a graph illustrating a heat reversible characteristic of the reversible thermal recording sheet.

FIG. 5 shows a heat reversible characteristic of the reversible sheet 101. When the reversible sheet 101 in the white opaque condition at a room temperature is heated, a transmittance of the reversible sheet 101 starts to increase at a temperature A and reaches a maximum at a temperature B. Thereafter, even when the reversible sheet 101 is cooled to the room temperature, the transparent condition is maintained. This is due to the fact that the organic low-molecular substance 104 changes from the white opaque condition of the polycrystal to a semi-molten condition during the increase from the temperature A to the temperature B, and the crystal grows to become the transparent condition of the monocrystal upon cooling from the temperature B to the room temperature.

Thereafters when the reversible sheet 101 in the transparent condition is heated again to a temperature D or higher, an intermediate condition between the maximum transparent condition and the maximum white opaque condition is obtained. When the reversible sheet 101 in the intermediate condition is cooled to the room temperature, the initial white opaque condition is restored. This is due to the fact that the organic low-molecular substance 104 is molten at the temperature D or higher, and the polycrystal is deposited during cooling down to the room temperature. The temperatures A, B and D are preferably set to about 50 degrees, about 56–68 degrees and about 72 degrees, respectively. In this preferred embodiment, the reversible sheet 101 is heated by a thermal head 19 to record an image. The transparent condition and the white opaque condition for every picture element of the image can be set by changing energy to be applied to the picture element which depends on a resolution of the thermal head 19.

Referring back to FIG. 3, a colored layer 106 is located under the transparent polyester film 102, so as to intensify a contrast of the image recorded on the reversible sheet 101. That is, the colored layer 106 functions to make a transparent portion of the reversible sheet 101 contrast with a white opaque portion of the reversible sheet 101. For example, in the case where the colored layer 106 is black and where the image is formed by the transparent portion with the white opaque portion left as the background, the image looks black on the white background as viewed from the upper side. Conversely, the image may be formed by the white opaque portion with the transparent portion left as the background. Further, also in the case of changing the color of the colored layer 106 into red, blue or green, the same effect can be obtained.

Figure 1:
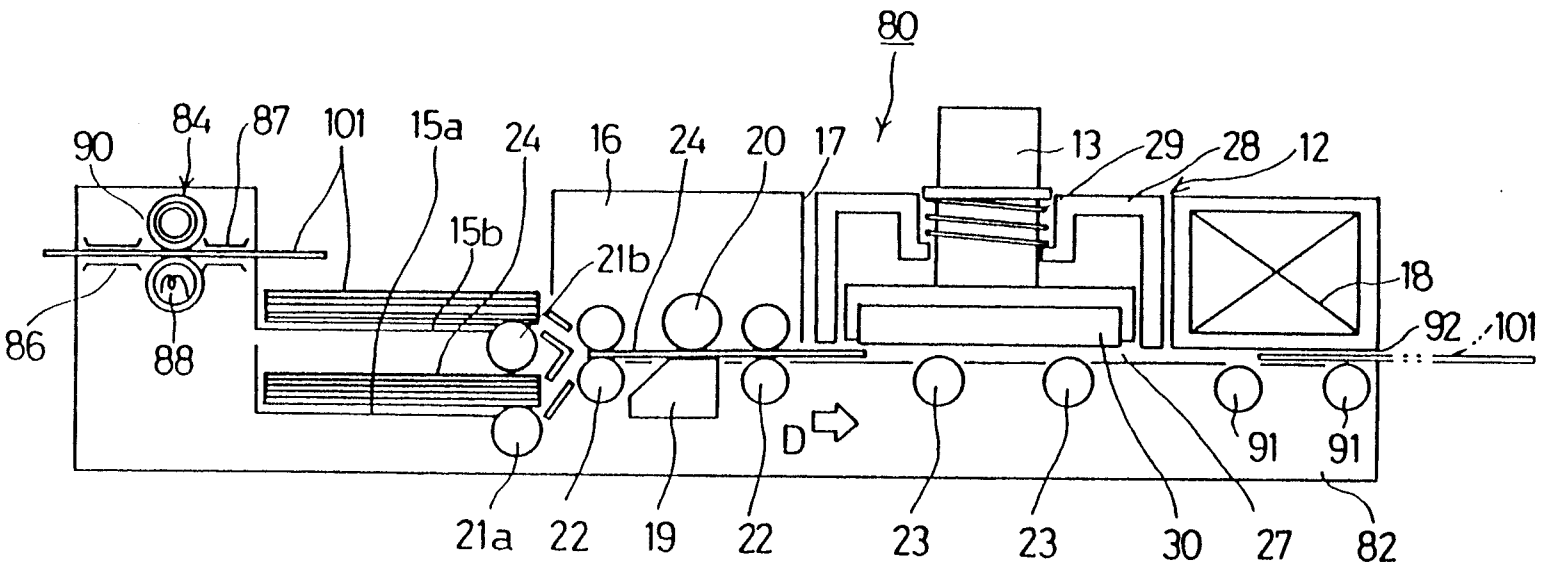
FIG. 1 is a schematic side view in section of a stamp device of an embodiment according to the present invention taken along the line E—E in FIG. 2.
Figure 2:
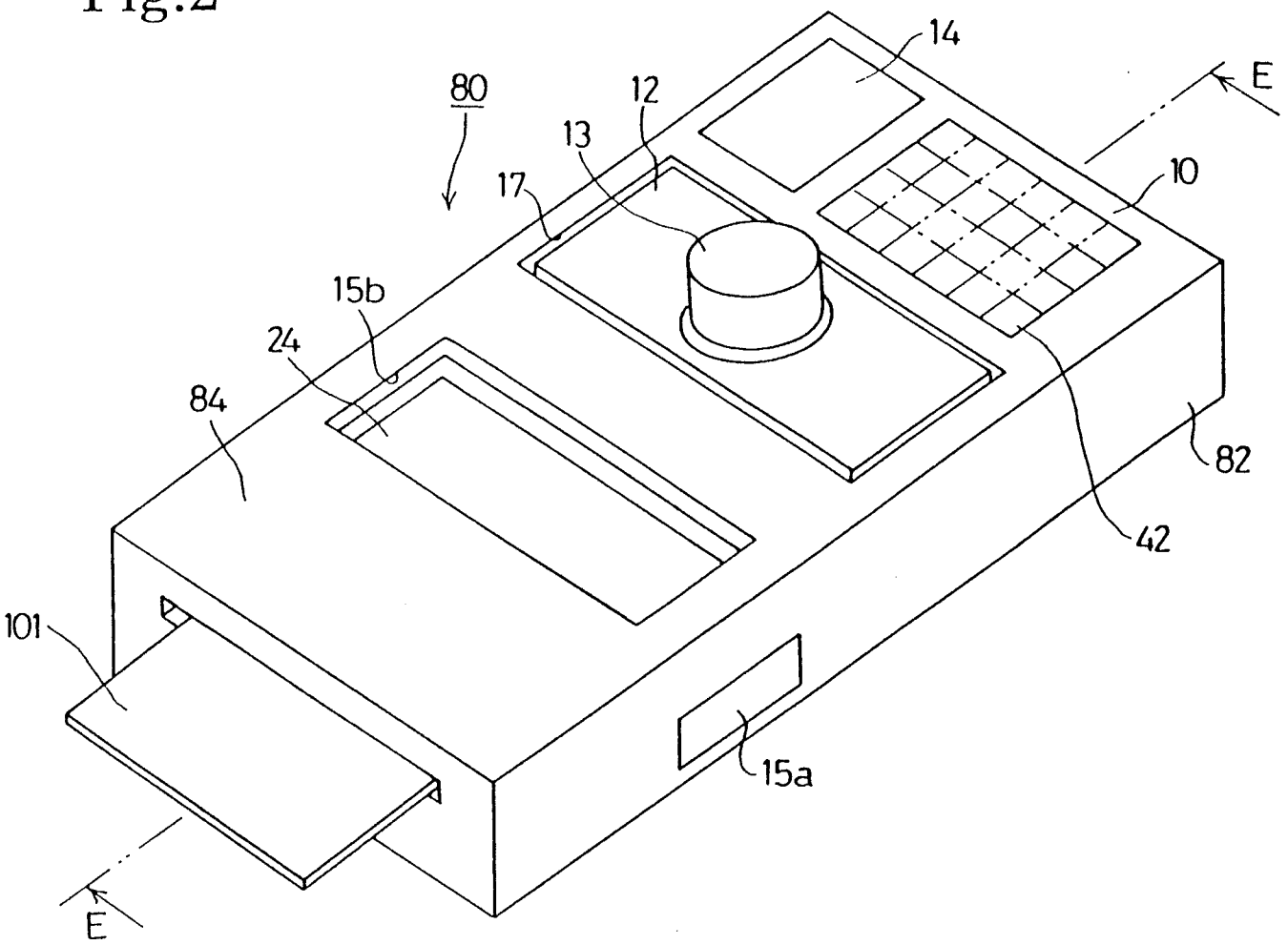
FIG. 2 is a perspective view of the stamp device.

Referring to FIGS. 1 and 2, there is shown a stamp device 80 employing the above-mentioned reversible sheet 101 according to the preferred embodiment.

FIG. 2 is a perspective view of the stamp device 80, and FIG. 1 is a cross section taken along the line E—E in FIG. 2. It is to be noted that the same parts as those described in the background relating to the parent application and shown in FIGS. 8–15 are denoted by the same reference numerals and the explanation thereof will be omitted hereinafter.

As shown in FIG. 2, the stamp device 80 includes a keyboard 10, a body 82, a stamp 12 and a display 14. As shown in FIG. 1, the body 82 is constituted of a stencil paper holding section 15*a*, a reversible sheet holding section 15*b*, an original creating section 16, a stamp holding section 17, a control section 18 and a heating roller section 84. The stencil paper holding section 15*a* and the reversible sheet holding section 15*b* are provided with a stencil paper drawing roller 21*a* and a reversible sheet drawing roller 21*b*, respectively. The stencil paper 24 and the reversible sheet 101 are adapted to be drawn by the stencil paper drawing roller 21*a* and the reversible sheet drawing roller 21*b*, respectively. Thereafter, the stencil paper 24 and the reversible sheet 101 thus drawn are adapted to be fed by stencil paper feeding roller pairs 22 and be heated by the thermal head 19. Thereafter, they are adapted to be further fed by stencil paper feeding rollers 23 in a direction D shown in FIG. 1. At the time the stencil paper 24 comes to a position just under an ink pad 30, the feeding of the stencil paper 24 is stopped. On the other hand, the reversible sheet 101 after being heated by the thermal head 19 passes through the stamp holding section 17, and is further fed by reversible sheet feeding rollers 91 to be discharged from a discharge opening 92 formed on a side surface of the body 82.

The construction of the parts other than the heating roller section 84 is substantially the same as that in the parent application described in the background and shown in FIGS. 8–15, and so the detailed explanation of the same parts will be omitted hereinafter. The heating roller section 84 is constituted of sheet guides 86 and 87 for smoothing the feeding of the reversible sheet 101 and a heating roller pair 90 having a heating device 88 in one roller at a central portion thereof.

A control system of the stamp device 80 will be described with reference to the block diagram shown in FIG. 6. The keyboard 10 is connected to an input interface 58 in a microcomputer 56. The input interface 58 is connected through a bus line 60 to a CPU 62, a ROM 64, a RAM 66, a character generator (CG-ROM) 68 for thermal perforation of the stencil paper 24, a character generator (CG-ROM) 69 for display, and an output interface 98.

The ROM 64 includes a program memory 71 previously storing a program for controlling the whole operation of the stamp device 80 and a dictionary memory 72 to be used for kana/kanji conversion or the like. The RAM 66 includes an input buffer 73 for storing data input from the keyboard 10, a thermal perforation buffer 74 and a shift register 75 for storing data for thermal perforation of the stencil paper 24, and other necessary counters and registers.

The CG-ROM 68 serves to generate dot patterns according to code data of characters input, and the CG-ROM 69 serves to generate dot patterns to be displayed on the display 14.

A head driving circuit 76, a motor driving circuit 77, a display driving circuit 78, a heating roller driving circuit 97 and a heating device driving circuit 96 are connected to the output interface 98. The thermal head 19, paper feeding motors 32, the display 14, the heating roller pair 90 and the heating device 88 are connected to the circuits 76, 77, 78, 97 and 96, respectively. The paper feeding motors 32 are so provided as to correspond to the stencil paper drawing roller 21*a*, the reversible sheet drawing roller 21*b*, the stencil paper feeding roller pairs 22, the stencil paper feeding rollers 23 and the reversible sheet feeding rollers 91.

Figure 7A:
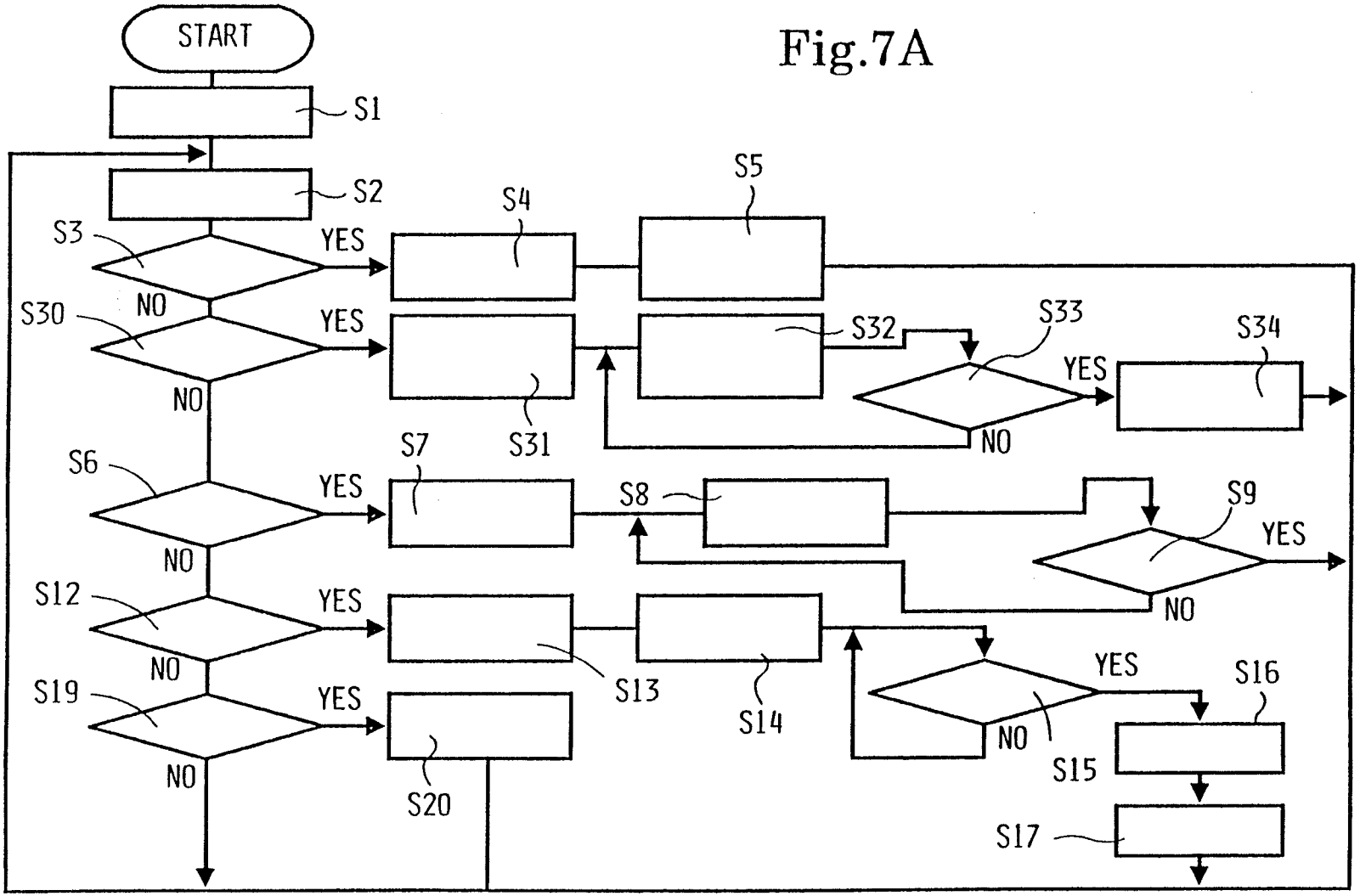
FIG. 7A is a flowchart illustrating an essential part of a program stored in a program memory shown in FIG. 6.
Figure 8:
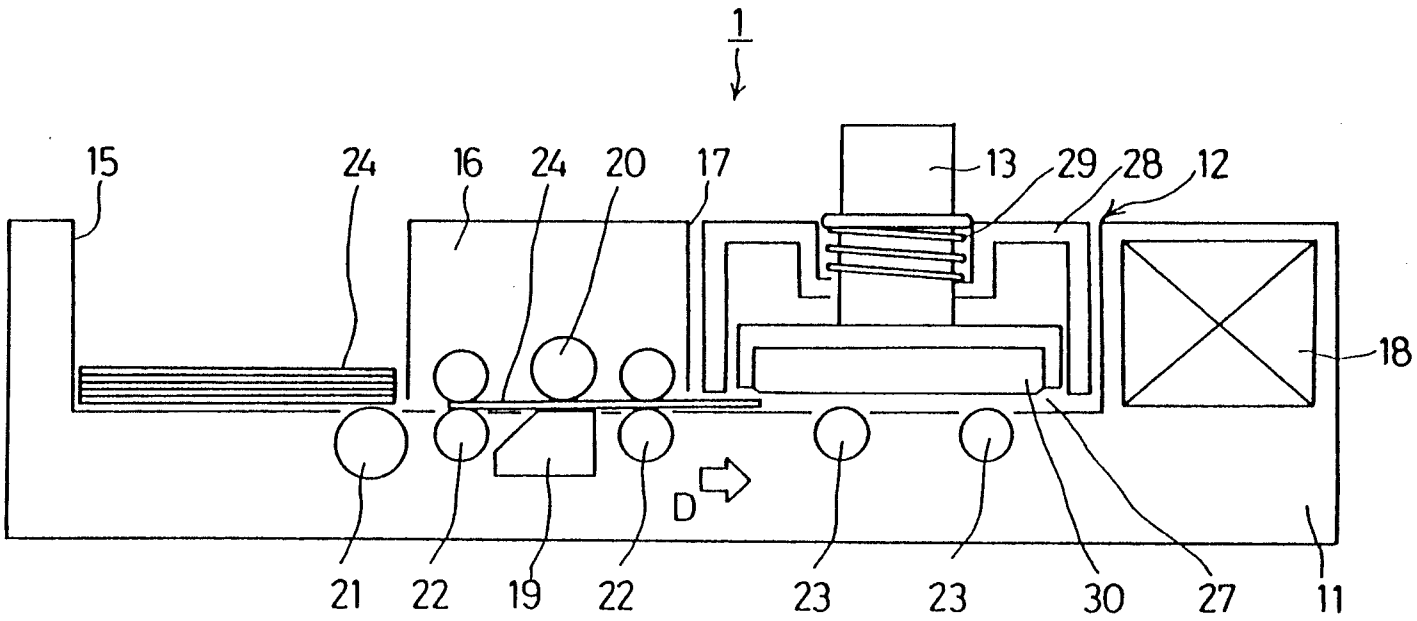
FIG. 8 is a cross section of a stamp device taken along the line F—F in FIG. 9.
Figure 9:
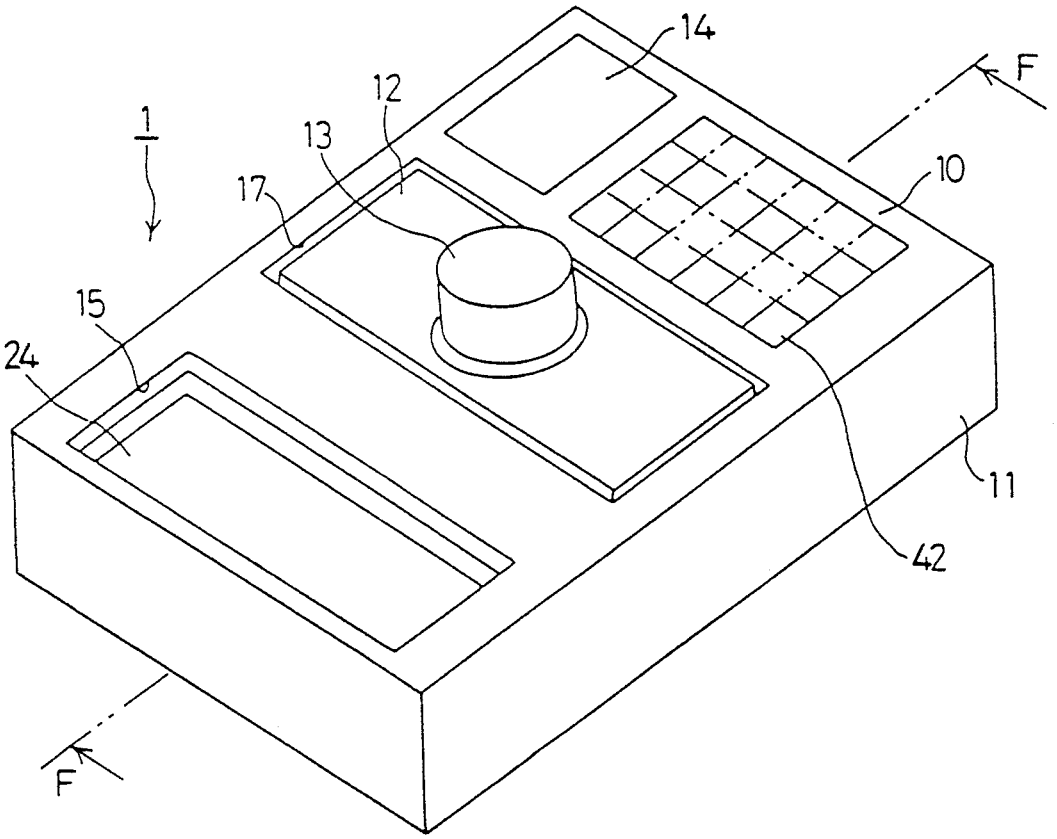
FIG. 9 is a perspective view of the stamp device of FIG. 8.
Figure 10:
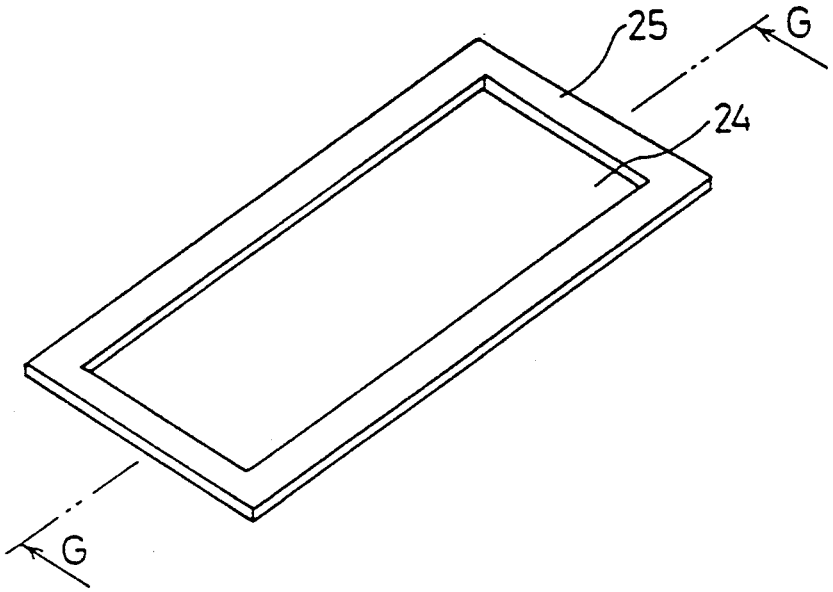
FIG. 10 is a perspective view of the thermal stencil paper.
Figure 11:
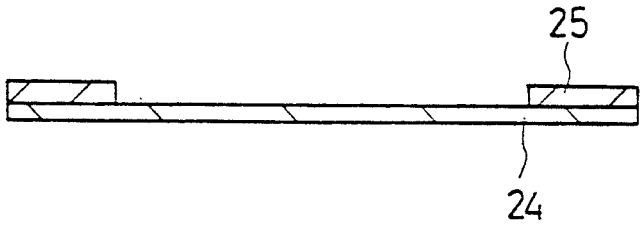
FIG. 11 is a cross section taken along the line G—G in FIG. 10.
Figure 12:
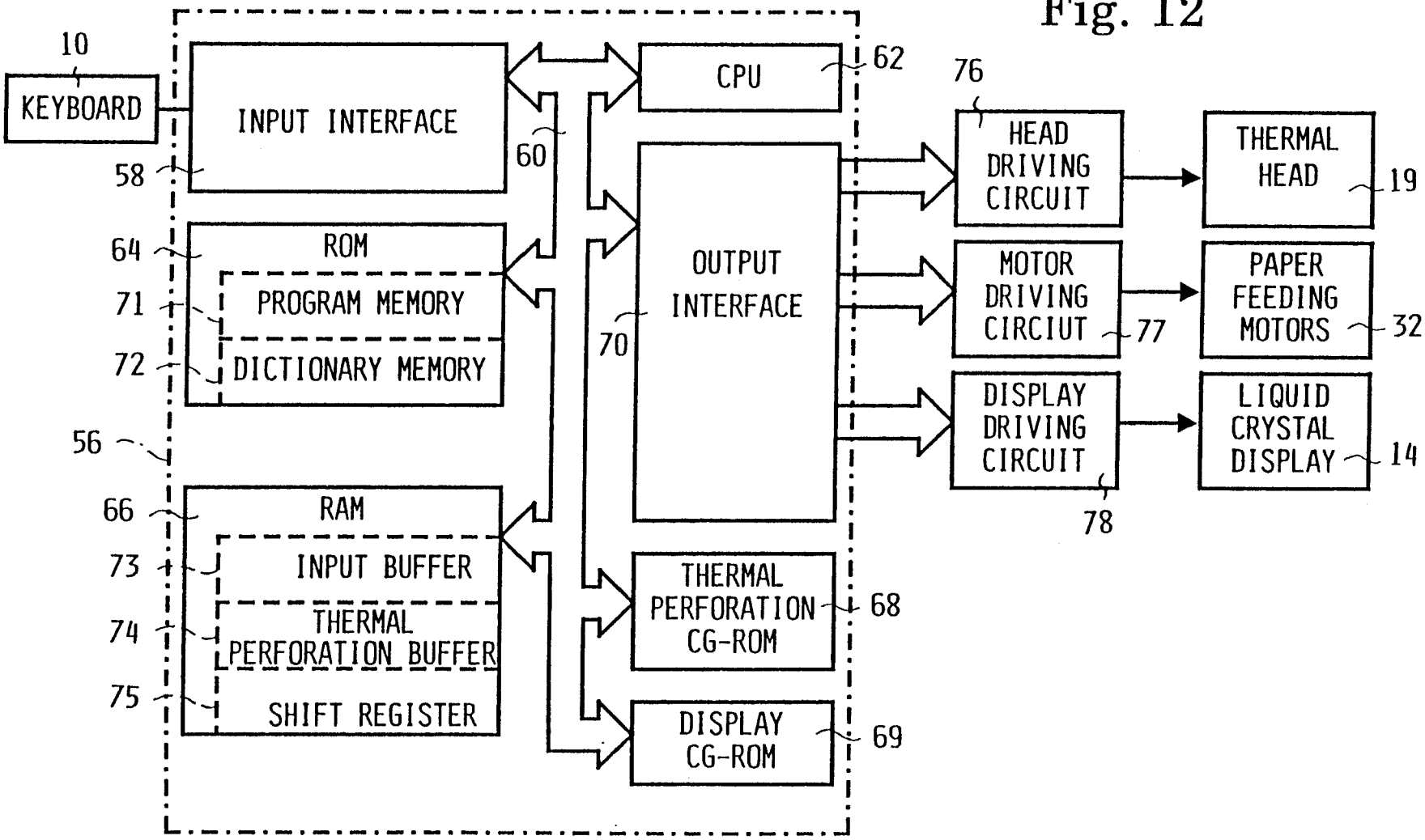
FIG. 12 is a block diagram illustrating the control system of the stamp device of FIG. 8.
Figure 13:
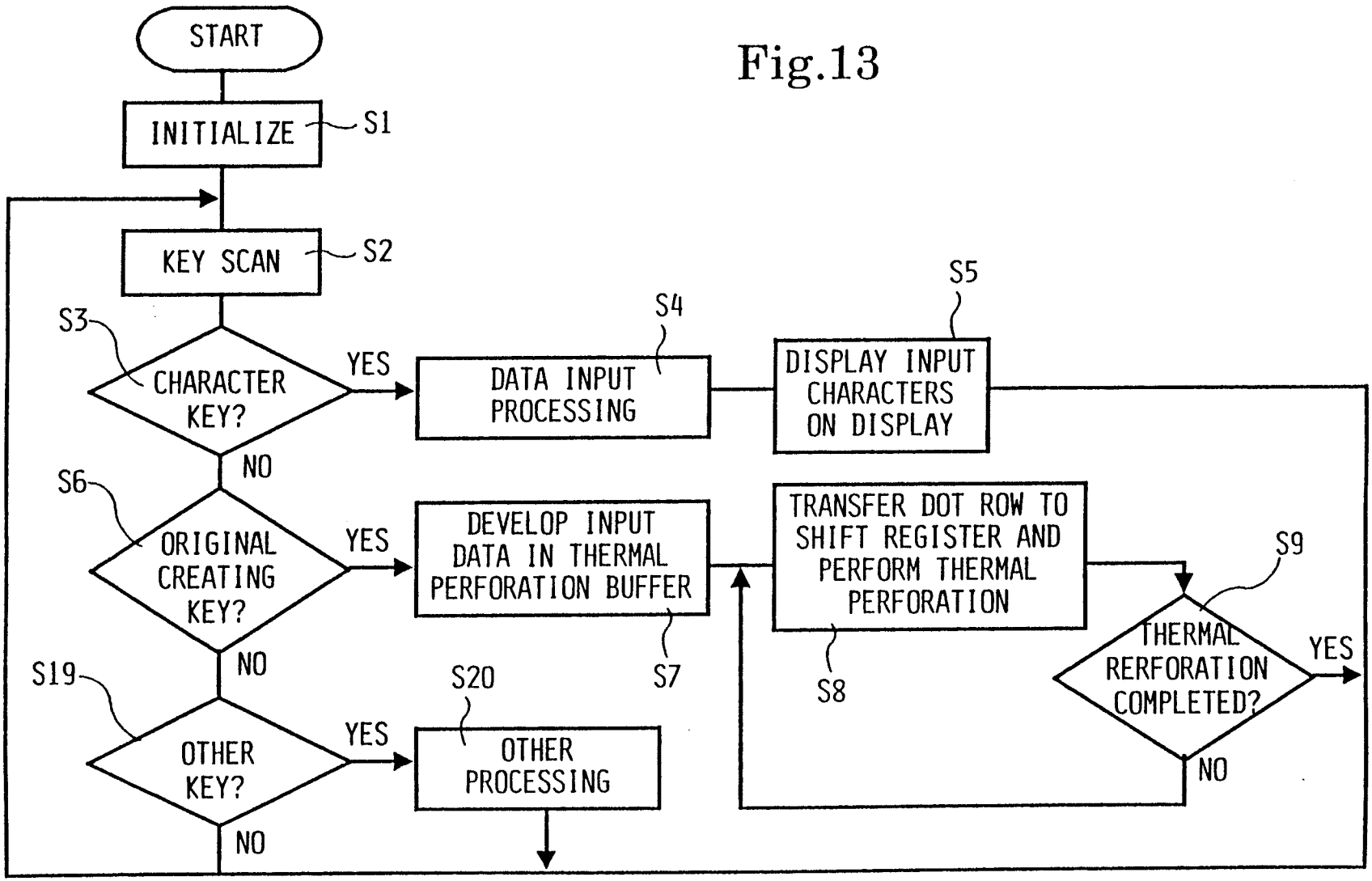
FIG. 13 is a flowchart illustrating an essential part of a program stored in a program memory shown in FIG. 12.
Figure 14:
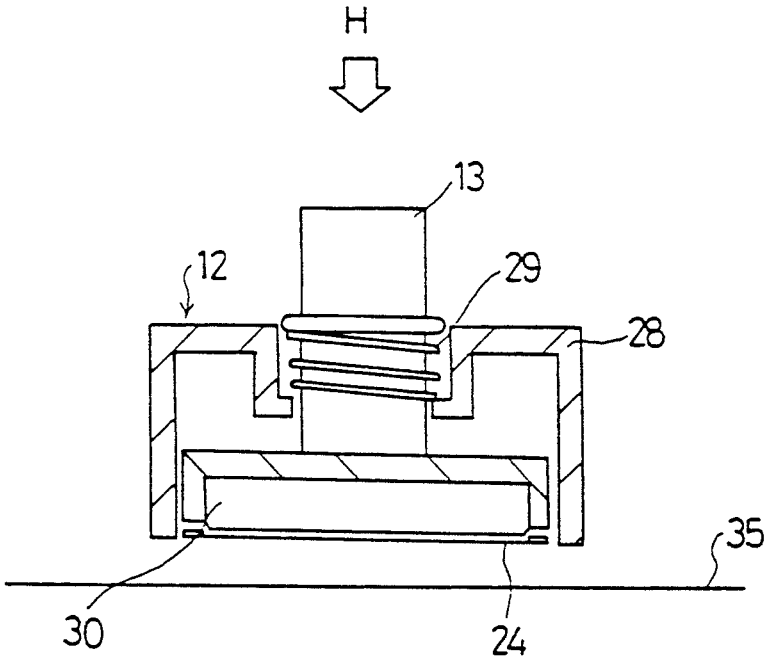
FIG. 14 is a sectional view of the stamp removed from the stamp device of FIG. 8, illustrating the stamp printing operation.
Figure 15:
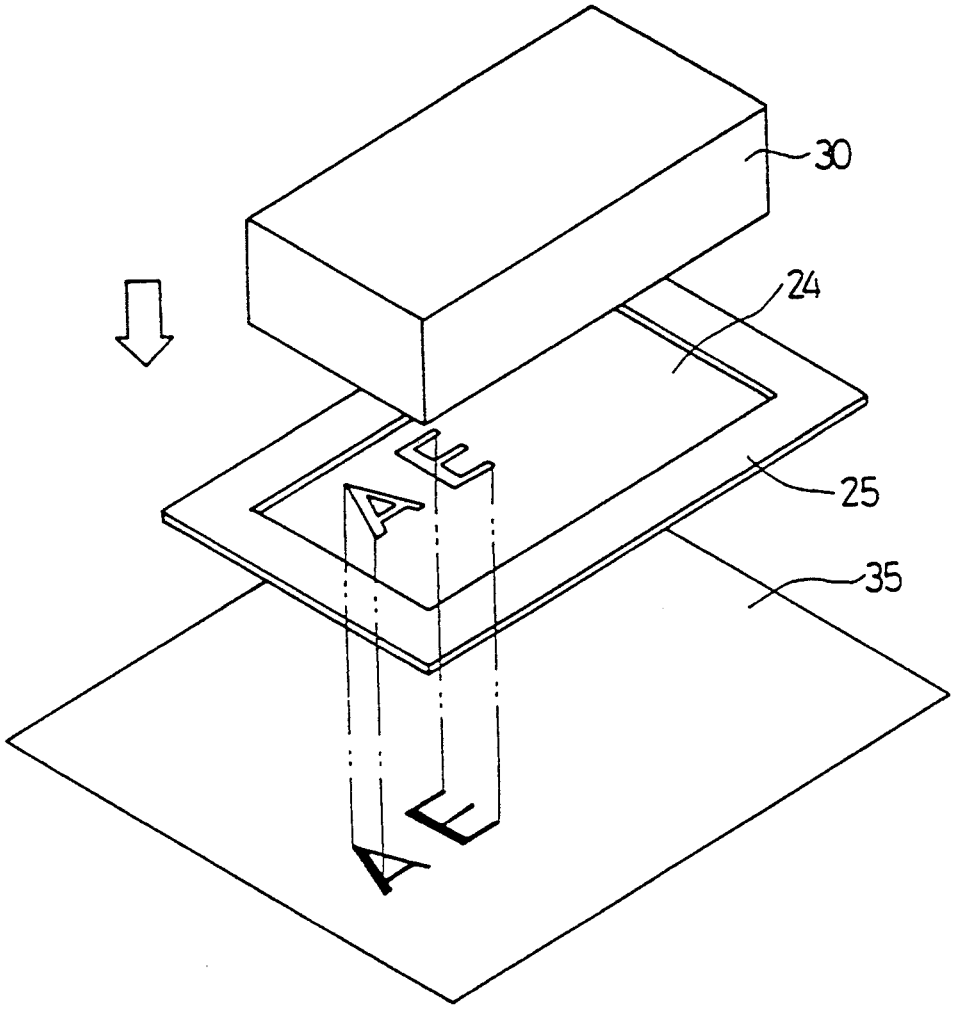
FIG. 15 is a schematic exploded perspective view of the stamp shown in FIG. 14, illustrating the stamp printing operation.

The operation of creating a stamp original by the stamp device 80 will now be described with reference to the flowchart shown in FIGS. 7A and 7B.

When power is applied to the stamp device 80, the buffers, registers, etc. in the RAM 66 are initialized, and the others are also initialized in step S1 (which will be hereinafter referred simply to as "Si", and the other steps will also similarly referred). Then, a string of characters is input from the keyboard 10 with the characters displayed on the display 14. That is, data for thermal perforation is input from the character key 42, and it is stored into the input buffer 73 in S2, S3 and S4. At the same time, in S5, the characters corresponding to the thermal perforation data are displayed on the display 14 through the CG-ROM 69.

When a confirming key is depressed, so as to confirm the above edited image by utilizing the reversible sheet 101, the reversible sheet 101 stored in the reversible sheet holding section **15*b* is drawn by the reversible sheet drawing roller 21*b*, and then, is fed by the stencil paper feeding roller pairs 22. At the same time, S31 is executed after S2 and S30, in which the dot patterns generated in the CG-ROM 68 according to the code data input are developed in the thermal perforation buffer 74**.

Then, the program proceeds to S32 in which the dot patterns developed in the thermal perforation buffer 74 are transferred by every row of dots to the shift register 75 to thermally record the row of dots on the reversible sheet 101. In S33, it is determined whether or not all the data have been recorded on the reversible sheet 101, and the steps of S32 and S33 are repeated to finally obtain the result of thermal recording constituted of 96 dots over the length of the heat generating element array. At this time, the thermally recorded reversible sheet 101 is fed by the stencil paper feeding roller pairs 22 and the stencil paper feeding rollers 23 in a direction D shown in FIG. 1. After passing through the stamp holding section 17, the reversible sheet 101 is further fed and discharged from the discharge opening 92 to the outside of the stamp device 80 by the reversible sheet feeding rollers 91. In the above operation, the reversible sheet 101 is vertically oriented so that the recording layer 103 side of the reversible sheet 101 may contact the thermal head 19.

Thereafter, if the image thermally recorded on the reversible sheet 101 discharged from the discharge opening 92 is satisfactory, the stencil paper 24 as the original for printing is created. That is, when the original creating key is depressed, the stencil paper drawing roller **21*a* is driven to draw the stencil paper 24 from the stencil paper holding section 15*a*, and the stencil paper 24 is fed by the stencil paper feeding roller pairs 22. The subsequent operation is the same as that described in the background with respect to the parent application and shown in FIGS. 8–15**, and so the explanation thereof will be omitted hereinafter.

If the image thermally recorded on the reversible sheet 101 is unsatisfactory, the image is erased in the following manner. That is, the reversible sheet 101 is supplied to the sheet guide 86. In this condition, when an erasing key is depressed (S12), the program proceeds through S2 and S12 to S13, in which the heating roller pair 90 starts to be rotated (S13), and the heating device 88 is heated (S14). The reversible sheet 101 is fed by the heating roller pair 90 heated to the temperature D or higher, and passes through the heating roller pair 90. As a result, the image thermally recorded on the reversible sheet 101 is thermally erased owing to the above-mentioned principle (S15). The reversible sheet 101 in which the image previously recorded has been erased is discharged to the reversible sheet holding section **15*b*. Then, the heating device 88 is turned off (S16), and the heating roller pair 90 stops rotating (S17). In the above operation, the reversible sheet 101 is vertically oriented so that the recording layer 103 side of the reversible sheet 101 may contact the roller of the heating roller pair 90 in which the heating device 88 is provided, that is, the lower roller as viewed in FIG. 1**.

Then, the data is edited again by using the keyboard 10 and is similarly thermally recorded on the reversible sheet 101. This operation is repeated many times until a satisfactory stamp image is obtained. The reversible sheet 101 is durable and withstands frequently repeated thermal recording and erasing, so that the stamp image can be surely confirmed before carrying out the thermal perforation of the stencil paper 24, and the stencil paper 24 can be effectively used without waste.

Although the heat generating element array is constituted of 96 heat generating elements in the above preferred embodiment, the number of the heat generating elements may be arbitrarily changed.

In the case where different characters are intended to be printed after the above-mentioned printing operation, the stencil paper 24 attached to the ink pad 30 of the stamp 12 is peeled off, and the stamp 12 is then set in the stamp holding section 17 of the body 82 of the stamp device 80. Thereafter, a new stamp original is created in the same manner as the above. Further, the stencil paper 24 after printing may be preserved for the purpose of reuse at any time. Accordingly, it is unnecessary to re-create a new original having the same stamp image as that of the stencil paper 24 previously created, thus improving the economy of the system.

Further, although the keyboard 10 of the stamp device 80 is employed as the inputting means in the above preferred embodiment, data such as characters or marks may be input from a personal computer or the like to a receiving terminal (not shown) of the stamp device 80. Also in this case, a stamp image may be formed in the same procedure as the above.

Further, although the heating roller pair 90 is used to erase the image thermally recorded on the reversible sheet 101, the thermal head 19 may be used to erase the image so that the energy to be applied to the thermal head 19 is suitably changed.

Further, a conventional thermal recording sheet on which a non-erasable image is recorded by heat may be used instead of the reversible sheet. Conventional thermal recording sheets are cheaper than stencil paper, and therefore the cost of using conventional thermal recording sheets in the device is much lower than using stencil paper.

As is apparent from the above description, according to the stamp device of the present invention, an original for printing can be simply created by inputting data such as characters or figures intended to be printed and thermally perforating the thermal stencil paper. Further, the thermal recording on the reversible thermal recording sheet for confirmation of a stamp image and the thermal perforation through the thermal stencil paper for creation of a stamp original can be carried out by using the single thermal head. Further, the data previously recorded on the reversible thermal recording sheet can be erased by using the heating roller to carry out frequently repeated thermal recording and erasing of data on the recording sheet, thus decreasing a cost for the recording sheet, avoiding wasteful use of the thermal stencil paper, and decreasing cost for the stamp device.

While advantageous embodiments have been chosen to illustrate the invention, it will be understood by those skilled in the art that various changes and modifications can be made therein without departing from the scope of the invention as defined in the appended claims.

What is claimed is:

1. A stencil making device for forming images on a thermal recording sheet and a thermal stencil sheet comprising:

an input inputting image data;

a memory that stores the input data;

a thermal recording sheet supply;

a thermal stencil sheet supply;

a heating device that thermally forms an image from the image data on a thermal recording sheet for proofing the image, and that thermally perforates an image corresponding to the image data on a thermal stencil sheet for printing;

a feeder that feeds a thermal recording sheet from the thermal recording sheet supply and a thermal stencil sheet from the thermal stencil sheet supply to said heating device;

a stamp that applies ink to a stencil sheet thermally perforated by the heating device;

a selector that selects one of a thermal recording sheet and a thermal stencil sheet for feeding;

control means for controlling forming of the image a controller that selectively controls the feeding of one of a thermal recording sheet from the thermal recording sheet supply and a thermal stencil sheet from the thermal stencil sheet supply to the heating device according to a a selection made by the selector; and a discharge that discharges a thermal recording sheet from the stencil making device for proofing.

2. The stencil making device of claim 1, wherein said heating device comprises a thermal head having an array of heating elements.

3. The stencil making device of claim 1, wherein said feeder comprises a recording sheet feeding roller for feeding a thermal recording sheet to said heating device and a stencil sheet feeding roller for feeding a thermal stencil sheet to said heating device.

4. The stencil making device of claim 1, wherein said controller comprises a character generator for generating the image to be recorded on a thermal recording sheet and the image to be perforated on a thermal stencil sheet from the input image data.

5. The stencil making device of claim 4, further comprising a display that displays the image generated by said controller.

6. The stencil making device of claim 1, wherein said discharge comprises discharge rollers for discharging a thermal recording sheet having an image formed thereon from the device.

7. The stencil making device of claim 1, further comprising a thermal recording sheet formed of a reversible sheet capable of having a recorded image thereon erased by heating.

8. The stencil making device of claim 7, further comprising a heating section for heating the reversible sheet prior to feeding to said hearing device.

9. The stencil making device of claim 8, wherein said reversible sheet is formed of a transparent film and a recording layer made of a resin and an organic low-molecular substance dispersed therein.

10. The stencil making device of claim 1, further comprising a recycling device for erasing a used thermal recording sheet and feeding it to the thermal recording sheet supply.

11. The stencil making device of claim 1, further comprising an erasing device for erasing the image formed on a thermal recording sheet.

12. The stencil making device of claim 11, wherein said erasing device comprises a second heating device for thermally erasing a recorded image on a thermal recording sheet, allowing a thermal recording sheet to be reused.

13. The stencil making device of claim 12, further comprising a thermal recording sheet formed of a reversible sheet having a thermal recording layer on a transparent film and wherein said recording layer of said thermal recording sheet is made of a resin and an organic low-molecular substance dispersed therein.

14. The stencil making device of claim 12, wherein said erasing device further comprises a feeding assembly to feed a thermal recording sheet from the second heating device to the thermal recording sheet supply.

15. A stencil making device for forming an image on a thermal recording sheet and a thermal stencil sheet, comprising:

an input inputting image data;

a generator generating an image based on the input image data;

a first heater thermally forming the image generated by said generator;

a recording sheet supply supplying a recording sheet to said first heater for thermally recording the image thereon;

a stencil sheet supply supplying a stencil sheet to said first heater for thermally perforating the image therein;

a selector that selects one of a thermal recording sheet and a thermal stencil sheet for feeding;

a controller selectively controlling supply of one of a recording sheet and a stencil sheet to said first heater according to a selection made by said selector;

a discharge discharging a recording sheet from the stencil making device for proofing; and a second heater thermally erasing an image recorded on a recording sheet, allowing a recording sheet to be reused.

16. The stencil making device of claim 15, further comprising introducing means for introducing a recording sheet into said second heating means.

17. The stencil making device of claim 15, further comprising feeding means for feeding the recording sheet from said second heating means to said recording sheet supply means.

18. The stencil making device of claim 15, further comprising a memory that stores the input image data, and wherein said first heater thermally forms the image based on the data stored in said memory.

19. The stencil making device of claim 18, wherein the device forms an image on a recording sheet formed of a reversible sheet having a thermal recording layer disposed on a transparent film and wherein said thermal recording layer is made of a resin and an organic low-molecular substance dispersed therein.

20. A method of forming a stencil in a stencil making apparatus, comprising the steps of:

inputting image data into the apparatus;

generating an image based on the image data;

confirming the image data by forming the image on a recording sheet by heating and displaying the recording sheet with the image thereon;

creating the stencil by forming the confirmed image on a stencil sheet by heating; and thermally erasing the recorded image on the recording sheet, allowing the recording sheet to be reused.

21. The method of claim 20, wherein the step of confirming the image data includes forming the image on a recording sheet formed of a reversible sheet having a thermal recording layer disposed on a transparent film and wherein the thermal recording layer is made of a resin and an organic low-molecular substance dispersed therein.

* * * * *